US010464781B2

(12) United States Patent
Gerstenmeyer

(10) Patent No.: US 10,464,781 B2
(45) Date of Patent: Nov. 5, 2019

(54) METHOD FOR OPERATING AN ELEVATOR SYSTEM

(71) Applicants: ThyssenKrupp Elevator AG, Essen (DE); ThyssenKrupp AG, Essen (DE)

(72) Inventor: Stefan Gerstenmeyer, Filderstadt (DE)

(73) Assignee: thyssenkrupp AG, Essen (DE)

( * ) Notice: Subject to any disclaimer, the term of this patent is extended or adjusted under 35 U.S.C. 154(b) by 364 days.

(21) Appl. No.: 15/529,992

(22) PCT Filed: Nov. 10, 2015

(86) PCT No.: PCT/EP2015/076142
§ 371 (c)(1),
(2) Date: May 25, 2017

(87) PCT Pub. No.: WO2016/083116
PCT Pub. Date: Jun. 2, 2016

(65) Prior Publication Data

US 2017/0313545 A1 Nov. 2, 2017

(30) Foreign Application Priority Data

Nov. 27, 2014 (DE) ..... 10 2014 224 323

(51) Int. Cl.
*B66B 1/24* (2006.01)
*B66B 9/00* (2006.01)

(52) U.S. Cl.
CPC ..... *B66B 1/2466* (2013.01); *B66B 1/2491* (2013.01); *B66B 9/003* (2013.01); *B66B 2201/401* (2013.01); *B66B 2201/402* (2013.01)

(58) Field of Classification Search
CPC ..... B66B 1/2466
USPC ..... 187/247
See application file for complete search history.

(56) References Cited

U.S. PATENT DOCUMENTS 3,317,005 A 5/1967 Kehoe
7,621,376 B2 * 11/2009 Duenser ..... B66B 9/00 187/247
8,739,936 B2 * 6/2014 Kostka ..... B66B 1/2433 187/249
8,827,043 B2 * 9/2014 Kostka ..... B66B 1/2433 187/249

(Continued)

FOREIGN PATENT DOCUMENTS

CN 1721311 A 1/2006
CN 103502133 A 1/2014

(Continued)

OTHER PUBLICATIONS

Korean Office Action for KR Application No. 10-2017-7014527 dated Nov. 26, 2018 with English translation, 12 pages.

(Continued)

*Primary Examiner* — David S Warren
(74) *Attorney, Agent, or Firm* — RMCK Law Group PLC

(57) ABSTRACT

The present disclosure relates to a method for operating an elevator system, which is embodied as shaft-changing multi-car system. A number of cars is assigned to at least three elevator shafts. The cars can be moved in upwards direction and downwards direction inside the individual elevator shafts, as well as between the individual elevator shafts. A successive reversal of the travel directions of the respective cars occurs hereby.

10 Claims, 3 Drawing Sheets

(56) References Cited

U.S. PATENT DOCUMENTS

| | | | | |
|---|---|---|---|---|
| 2003/0217893 | A1* | 11/2003 | Dunser | B66B 1/2466 187/249 |
| 2006/0011420 | A1* | 1/2006 | Duenser | B66B 9/00 187/382 |
| 2011/0272220 | A1* | 11/2011 | Kostka | B66B 1/2433 187/382 |
| 2012/0012427 | A1* | 1/2012 | Kostka | B66B 1/2433 187/382 |
| 2014/0190774 | A1 | 7/2014 | Hsu et al. | |
| 2017/0313545 | A1* | 11/2017 | Gerstenmeyer | B66B 1/2466 |
| 2018/0127242 | A1* | 5/2018 | Witczak | B66B 9/003 |
| 2018/0215581 | A1* | 8/2018 | Hsu | B66B 5/0031 |

FOREIGN PATENT DOCUMENTS

| | | | |
|---|---|---|---|
| DE | 20206290 | U1 | 8/2002 |
| EP | 1616832 | A2 | 1/2006 |
| EP | 1619157 | A1 | 1/2006 |
| JP | H07206282 | A | 8/1995 |
| KR | 1020140021674 | | 2/2014 |
| WO | 2012154178 | A1 | 11/2012 |
| WO | 2015084367 | A1 | 6/2015 |

OTHER PUBLICATIONS

International Search Report and Written Opinion for International Application No. PCT/EP2015/076142 dated Feb. 19, 2016, 3 pages.
Chinese Office Action for CN Application No. 201580062423.9 dated Sep. 4, 2018, 6 pages.

* cited by examiner

METHOD FOR OPERATING AN ELEVATOR SYSTEM

CROSS-REFERENCE TO RELATED APPLICATIONS

This application is a 371 U.S. National Stage of International Application No. PCT/EP2015/076142, filed Nov. 10, 2015, which claims priority to German Application No. 10 2014 224 323.8 filed on Nov. 27, 2014. The disclosure of each of the above applications is incorporated herein by reference in their entirety.

FIELD

The present disclosure relates to a method for operating an elevator system as well as a corresponding elevator system.

BACKGROUND

High-rise buildings and buildings comprising a plurality of floors require complex elevator systems in order to handle all transport processes as effectively as possible. During peak times, it is in particular possible that a multitude of users wants to be transported from the ground floor of the building to the different floors of the building. During further peak times, a multitude of users, for example, is to be transported from the different floors to the ground floor.

This requires logistically optimized elevator systems, which handle load peaks and changes as quickly as possible. Individual users are to be thereby transported to their target floor as quickly as possible, without long waiting periods. On the one hand, a car is to be provided as quickly as possible on an initial floor, on which an individual user wants to enter the elevator system. On the other hand, the car, which the user enters, is to reach the corresponding target floor as quickly as possible, without a large number of unnecessary stopovers. A user should furthermore need to change the car as infrequently as possible, until he reaches the target floor. When a user needs to change the car, the parameter of the shortest possible waiting periods applies for the next connecting car as well.

Elevator systems for such purposes are known. Single-car systems or one-car systems, respectively, have for example one car in an elevator shaft. Double-decker car systems have two cars in an elevator shaft. These two cars of a double-decker car system are fixedly connected to one another for the most part and cannot be moved independently from one another for the most part. Multi-car systems have at least two cars in an elevator shaft. These cars of a multi-car system can be moved independently from one another. Such multi-car systems comprising two cars, which can be moved independently from one another in an elevator shaft, are sold by applicant under the name "TWIN".

Shaft-changing multi-car systems prove to be particularly effective. A shaft-changing multi-car system thereby comprises a plurality of cars, which can be moved in a group of elevator shafts. The cars can hereby not only be moved vertically back and forth in the individual elevator shafts, but also horizontally between the individual elevator shafts. Cars of a shaft-changing multi-car system are thus not fixedly bound to an elevator shaft, as is the case in single-car systems or common multi-car systems.

The cars of a shaft-changing multi-car system can in particular change between the elevator shafts at an upper and/or at a lower end of the elevator shafts. For this purpose, corresponding changing mechanisms are provided. A changing of the cars between the elevator shafts on other advantageous floors, for example in the area of the shaft center, is possible as well. If the shaft-changing multi-car system comprises more than two elevator shafts, the individual cars can in particular change between all of these elevator shafts. Such a change of cars between elevator shafts can thereby be carried out for example only between adjacent elevator shafts or in particular also flexibly between non-adjacent elevator shafts.

An elevator system comprising individually movable elevator cars is known from EP 1 619 157 B1, in which elevator cars can change between individual shafts.

SUMMARY

The invention at hand seeks to improve the effectiveness of shaft-changing multi-car systems.

The invention proposes a method for operating an elevator system, which is embodied as a shaft-changing multi-car system, in the case of which a number of cars is assigned to at least three elevator shafts, wherein the cars can be moved in upwards direction and downwards direction inside the individual elevator shafts, as well as between the individual elevator shafts, comprising the following steps:

a) in a first operating state, assigning a travel direction UP or DOWN to each individual one of the elevator shafts such that all cars, which are located in a respective elevator shaft, move only in upwards direction or downwards direction, respectively, b) for an elevator shaft or a partial quantity of the at least three elevator shafts, canceling the assignment of the travel direction such that all cars, which are located in this one elevator shaft or this partial quantity of the at least three elevator shafts, is or are stopped, respectively, c) reversing the assignment of the travel direction in this one shaft or this partial quantity of the at least three elevator shafts such that all cars, which are located in this one elevator shaft or the partial quantity of the at least three elevator shafts, move only in one travel direction, which is opposite to the travel direction thereof in the first operating state, d) repeating steps b) and c) for further elevator shafts, until a desired number of elevator shafts or all elevator shafts have an assignment of a travel direction UP or DOWN, which is opposite to the assignment during the first operating state, for providing a second operating state.

To get from the first operating state to the second operating state, a successive reversal of the travel directions assigned to the individual elevator shafts is carried out advantageously. A reversal of the direction for the individual shafts thus advantageously takes place in succession. Advantageously, a reversal of the direction of the individual cars in particular takes place individually and in succession.

The invention further proposes an elevator system, which is embodied as a shaft-changing multi-car system, in the case of which a number of cars is assigned to at least three elevator shafts, wherein the cars can be moved in upwards direction and downwards direction inside the individual elevator shafts, as well as the individual elevator shafts, comprising:

a) means for assigning a travel direction UP or DOWN to each of the individual elevator shafts such that all cars, which are located in a respective elevator shaft, move only in upwards direction or downwards direction, respectively, b) means for canceling the assignment of the travel direction for an elevator shaft or a partial quantity of the at least three elevator shafts such that all cars, which are located in this one elevator shaft or this partial quantity of the at least three elevator shafts, is or are stopped, respectively, c) means for reversing the assignment of the travel direction in this one shaft or this partial quantity of the at least three elevator shafts such that all cars, which are located in this one elevator shaft or the partial quantity of the at least three elevator shafts, move only in one travel direction, which is opposite to the travel direction thereof in the first operating state, d) means for repeating the steps b) and c) for further elevator shafts, until a desired number of elevator shafts or all elevator shafts have an assignment of a travel direction UP or DOWN, which is opposite to the original assignment according to feature a).

Advantageously, the means are set up such that a reversing of the travel directions assigned to the individual elevator shafts is carried out successively, in order to get from the first operating state to the second operating state. It is in particular further provided that the means are advantageously further embodied such that the reversal of the direction of individual cars takes place individually and in succession. A reversal of the direction of the individual shafts in particular takes place in succession accordingly.

According to the invention, an elevator system is enabled to change between different operating states in a highly effective manner. It is important to point out that the used wording that cars, which are located in a respective elevator shaft, can move only in upwards direction or downwards direction, respectively, covers that these cars can also stop on a corresponding floor, for example in the event that a car is called by a user. Only a moving of the car in the direction opposite to the assigned travel direction is impossible.

The mentioned means for carrying out steps a), b), c) and d) are advantageously embodied as a control device. Such a control device can be integrated in the overall control of an elevator system, or can also cooperate with a corresponding elevator controller.

The invention makes it possible to increase the transportation capacity of an elevator system in a main travel direction, to which the majority of the elevator shafts is assigned at a certain point in time, by minimizing the average cycle time of the cars in the main travel direction. The average cycle time is understood to be the average time, which lapses while two consecutive cars pass a certain floor, for example a main stop, such as, for example, the ground floor stop. The cycle time mainly depends on stop times of the cars on individual floors, wherein the cycle time is increased in particular if different cars are to stop on the same floor. The stop times in particular comprise the time for opening and for closing the respective elevator or car doors, respectively, as well as the time for passengers to enter and exit. Safety distances between individual cars must be considered as well.

Advantageously, it is ensured that the assignment of all further elevator shafts is maintained during steps b) and c). This provides for a particularly effective conversion from a first operating state to a second operating state, wherein it is ensured at any time that there are cars, which move either in upwards or in downwards direction.

It is preferred that, during the first operating state, an exclusive travel direction UP is assigned to a plurality of elevator shafts and that a travel direction DOWN is assigned to a minimum number of elevator shafts, and that, in the second operating state, an exclusive travel direction DOWN is assigned to a plurality of elevator shafts and that an exclusive travel direction UP is assigned to a minimum number of elevator shafts or vice versa. The method according to the invention offers a highly effective possibility of conversion in particular for such operating states.

It is preferred that a movement of cars between the elevator shafts is carried out in an upper and/or a lower area of the respective elevator shafts. Corresponding changing mechanisms are provided for this purpose.

Particularly preferably, the method is used to operate an elevator system comprising at least one group of three elevator shafts, wherein, in the first operating state, an exclusive travel direction UP is assigned to two shafts in each of the at least one group, and a travel direction DOWN is assigned to one elevator shaft, and, in the second operating state, an exclusive travel direction DOWN is assigned to two elevator shafts, and an exclusive travel direction UP is assigned to one elevator shaft.

According to a particularly preferred embodiment of the method according to the invention, for which protection is sought separately, the information YES or NO is assigned to each car such that, in the event the information YES is assigned to a car, this car is available to transport passengers, and that, in the event that NO is assigned to a car, this car is not available to transport passengers. Cars, which do not move in a current main travel direction of the elevator system, can be blocked for a use by passengers by means of this measure. It can thus be ensured that such cars can be transported in a particularly quick manner back into an elevator shaft, to which the main travel direction of the elevator system is assigned. The transportation capacity of the elevator system as a whole can thus be increased. The information YES or NO is advantageously also assigned by means of the control device.

It is in particular provided hereby that, in the event that NO is assigned to a car, this car can be moved in upwards direction or downward direction, respectively, according to a travel direction, which is assigned to a respective elevator shaft, in which the car is located, but is not available for picking up passengers or users, respectively. As a rule, no persons or passengers, respectively, will be in this car in the event that NO is assigned to a car. It is possible however, to block such cars only for picking up additional passengers.

In a particularly advantageous manner, the state NO is only assigned to a car, if it is located in an elevator shaft, which belongs to a current minimum number of the elevator shafts. It can be ensured herewith that the plurality of the elevator shafts, which advantageously moves in the main travel direction of the elevator system, can be used optimally for transporting passengers.

It is particularly advantageous, if a switchover from a first operating state to a second operating state is made on the basis or in consideration, respectively, of at least a captured information. The captured information can for example be determined or prognosticated traffic volume, whereby this can be determined or prognosticated, respectively, in different ways. For example, corresponding sensors can be provided for this purpose, which capture passengers in individual cars and/or in the vicinity of the elevator system. Isolating devices can furthermore be provided in the vicinity of the elevator system for this purpose. It is also possible to provide an adaptive system in this context.

Further advantages and embodiments of the invention follow from the description and the enclosed drawing.

It goes without saying that the above-mentioned features and the features, which will still be explained below, cannot only be used in the respective specified combination, but also in other combinations or alone, without leaving the scope of the invention at hand.

The invention will now be shown schematically in the drawing by means of exemplary embodiments and will be described below with reference to the drawing.

DETAILED DESCRIPTION

Figure 1:
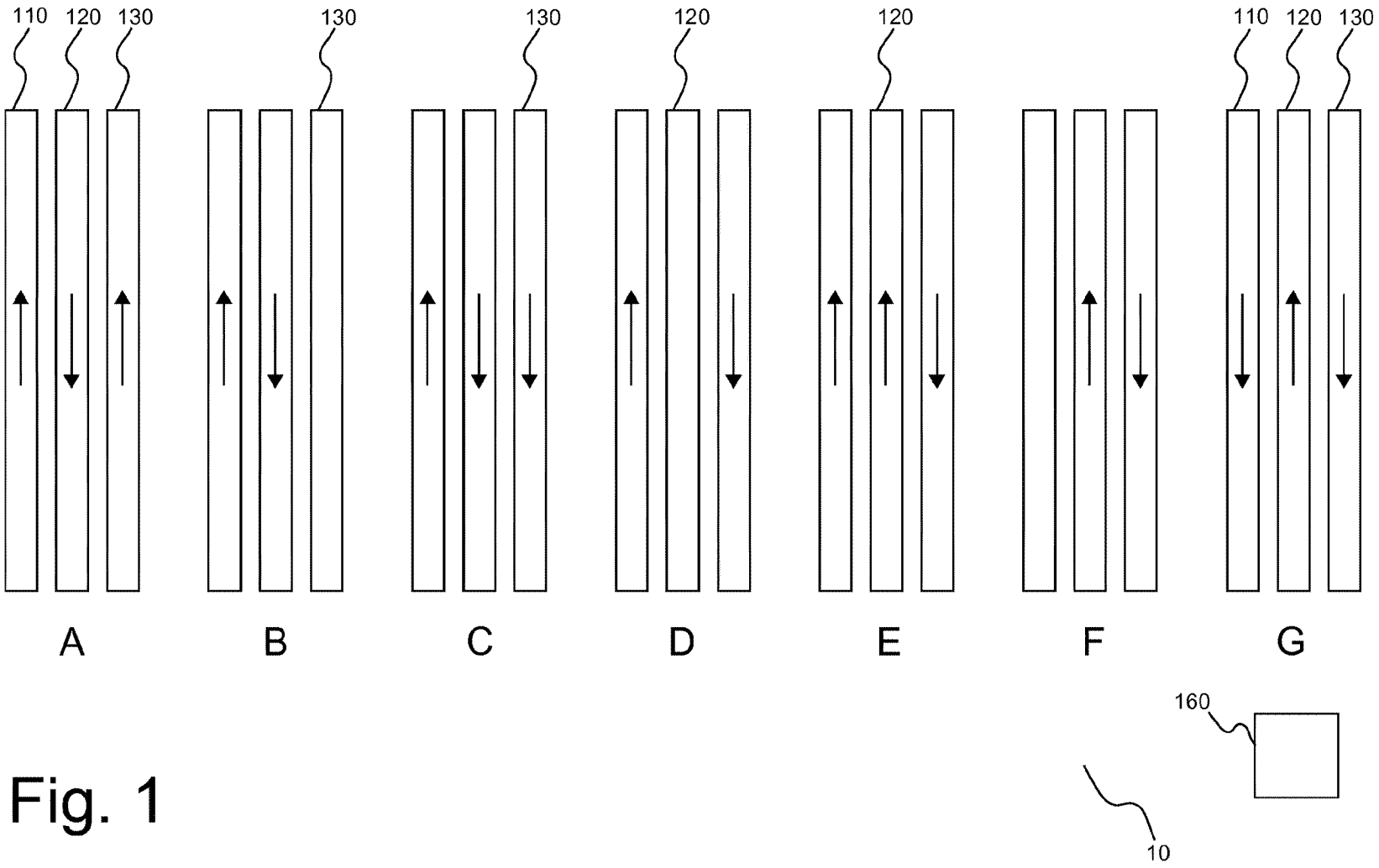
FIG. 1 shows a diagram for illustrating a preferred embodiment of the method according to the invention in a schematic manner.

An elevator system comprising three elevator shafts (110, 120, 130) is illustrated in FIG. 1 in a schematic manner and is identified as a whole with 10. The elevator system 10 is embodied as shaft-changing multi-car system. This means that cars, which can be moved in the individual elevator shafts (110, 120, 130), can also be moved between the individual elevator shafts (110, 120, 130). To simplify the diagram, the individual cars are not illustrated in FIG. 1. The elevator system comprises a control device, which is illustrated schematically and which is identified with 160.

To increase the transportation capacity of such an elevator system, it is typical that more cars than elevator shafts are provided. For example, two or more cars can be provided per elevator shaft, wherein for example more than two or less than two cars can also be located in a certain shaft at certain times.

Such an elevator system 10 comprises at least two changing mechanisms, by means of which the respective cars can be moved between the elevator shafts (110, 120, 130). These changing mechanisms are preferably provided in an upper area, in particular the top floor, and the lower area, in particular the lowermost floor or the ground floor, respectively. However, it is also possible to provide such changing mechanisms on any floors.

Exclusive travel directions of the individual elevator shafts are symbolized by means of arrows in FIG. 1. An arrow, which is oriented upwards, means that cars located in a corresponding shaft are moved only in upwards direction. It is important to clarify hereby that a stopping on floors, for example for users or passengers, respectively, to enter or exit, is also possible. Movements in downwards direction are not carried out in an elevator shaft, which is identified in this manner.

Arrows oriented downwards symbolize accordingly that an exclusive downwards travel direction is provided for corresponding cars.

Depending on traffic volume, the elevator system 10 is able to assign a travel direction in upwards direction (hereinafter identified as travel direction UP) to a plurality of elevator shafts, and to assign a travel direction in downwards direction (hereinafter identified as travel direction DOWN) to a corresponding minimum number of elevator shafts, or vice versa.

FIG. 1, state A, thus illustrates a first operating state, in which a travel direction UP is assigned to the two outer elevator shafts 110, 130, and in which a travel direction DOWN is assigned to the elevator shaft 120, which is located in the middle. The cars located in the elevator shafts 110, 130 hereby move in upwards direction, and are moved into the middle elevator shaft 120 by means of the corresponding changing mechanism when the top floor has been reached, and are moved in downwards direction in said middle elevator shaft. When reaching the lowermost floor, the cars are moved, in turn, into one of the outer elevator shafts 110, 130 by means of a corresponding changing mechanism, where an upwards movement takes place again. Advantageously, the cars arriving on the lowermost floor are moved alternately into the (left) elevator shaft 110 and the (right) elevator shaft 130.

The first operating state illustrated as state A is in particular suitable for a morning operation, during which many passengers enter a high-rise building and need to be moved to different floors or for example also to a top floor, for example a transfer floor.

A second operating state, in which the assignment of the travel directions to the elevator shafts 110, 120, 130 is exactly reversed, in which the travel direction DOWN is thus assigned to the outer elevator shafts 110, 130, and in which the travel direction UP is assigned to the middle elevator shaft, is illustrated as state G. This second operating state is in particular suitable for times, in which more passengers leave a high-rise building, than new passengers enter, thus for example for after-work situations.

To get from the first operating state to the second operating state, the invention proposes a successive reversal of the travel directions, which are assigned to the individual elevator shafts, as will be explained below.

As first step, to get from the first operating state to the second operating state, the assignment of the travel direction UP is cancelled for the elevator shaft 130. This has the result that all cars located in the elevator shaft are stopped on corresponding floors such that passengers can leave these cars on their respective target floors. The cars in the elevator shaft 130 also do not pick up passengers any longer. According to state B, this is symbolized in that no arrow is assigned to the elevator shaft 130. The elevator shafts 110, 120 hereby maintain their assigned travel direction, as is symbolized by the corresponding arrows.

State B can be brought about for example in that passengers, who stay in a car located in the elevator shaft 130, are notified that they must exit and must continue their ride in a different car, for example a car in the elevator shaft 110. The state B can also be brought about in that the assignment of the travel direction in the elevator shaft 130 is cancelled only when all passengers, who stay in a car in the elevator shaft 130, have reached their target floors. This can in particular also take place successively, in that a car, for example, which has reached the target floor of a passenger in elevator shaft 130, is thus blocked for further rides, until all passengers in cars, which are located in elevator shaft 130, have reached their target floor. In the state B, the elevator shaft 110 is available for upwards rides, and the elevator shaft 120, is available for downwards rides.

As next step, the travel direction assigned to the elevator shaft 130 is reversed, in the illustrated example, the travel direction DOWN is thus assigned to the elevator shaft 130. This situation is illustrated in state C by means of corresponding arrows.

In a subsequent step, the assignment of the travel direction UP of the middle elevator shaft 120 is cancelled. This is illustrated in state D. It can be seen that in this state, the travel directions, which were most recently assigned to the elevator shafts 110, 130, are maintained, at least one elevator shaft, in which rides in upwards direction are possible, and least one elevator shaft, in which rides in downwards direction are possible, is also maintained in this state D. In state D, it may be necessary to relocate or to move cars, respectively, between two non-adjacent elevator shafts. In a subsequent step, the travel direction assigned to the middle shaft 120 is reversed, so that, according to state E, the elevator shaft 120 now has an assigned travel direction UP.

In a subsequent step, the assignment of the travel direction of the elevator shaft 110 is cancelled, as illustrated according to state F. It is also ensured here that rides in upwards direction and downwards direction are also possible during this state.

In a subsequent step, the travel direction assigned to the elevator shaft 110 is also reversed, thus resulting in the second operating state according to state G.

As a whole, this results in an extremely flexible changeover from the first operating state (state A) into the second operating state (state G), which allows an effective transport in upwards direction as well as downwards direction at any time or according to each intermediate state B to F, respectively, and which is simultaneously comfortable for all passengers, because an unexpected reversal of the travel direction does not occur for passengers located in cars.

It is possible hereby to temporarily park individual cars in sections of individual elevator shafts, which are not used, if a current traffic situation allows it, and if this does not excessively reduce the efficiency of the elevator system as a whole.

As mentioned, the illustrated method is advantageously accomplished by the control device 160, which is assigned to the elevator system. Such a control device can learn certain traffic patterns or profiles, respectively, or can optimize them in the further course, for example by inputting or learning corresponding information relating to main traffic volume or main travel directions, respectively, at certain times of a day and/or week.

To obtain such information, the elevator can be equipped for example with sensors, via which e.g. a number of passengers in a car or in a building can be determined, call input devices or additional capturing means for passengers, such as, for instance, cameras, isolating devices, etc.

Corresponding main travel directions prognosticated by a control device, for example according to the first operating state (state A) in upwards direction or according to the second operating state (state G) in downwards direction, respectively, can be learned or adjusted accordingly, respectively, by the elevator controller, so that the elevator controller can reverse the main travel direction at certain times, as described explicitly above with reference to FIG. 1.

Such a method or elevator system, respectively, can be optimized further in that for example interfaces for user inputs, in particular call inputs and/or display devices for displaying information for passengers, are used. It is thus possible to recognize or to optimize for example passenger behaviors early on. For example, a current operating state can further be displayed through this. For example, it is also possible to display expected arrival times and cars or elevator shafts, respectively, which are to preferably be used, to the users or passengers, respectively, so that an efficient passenger transport can be made available.

Figure 2:
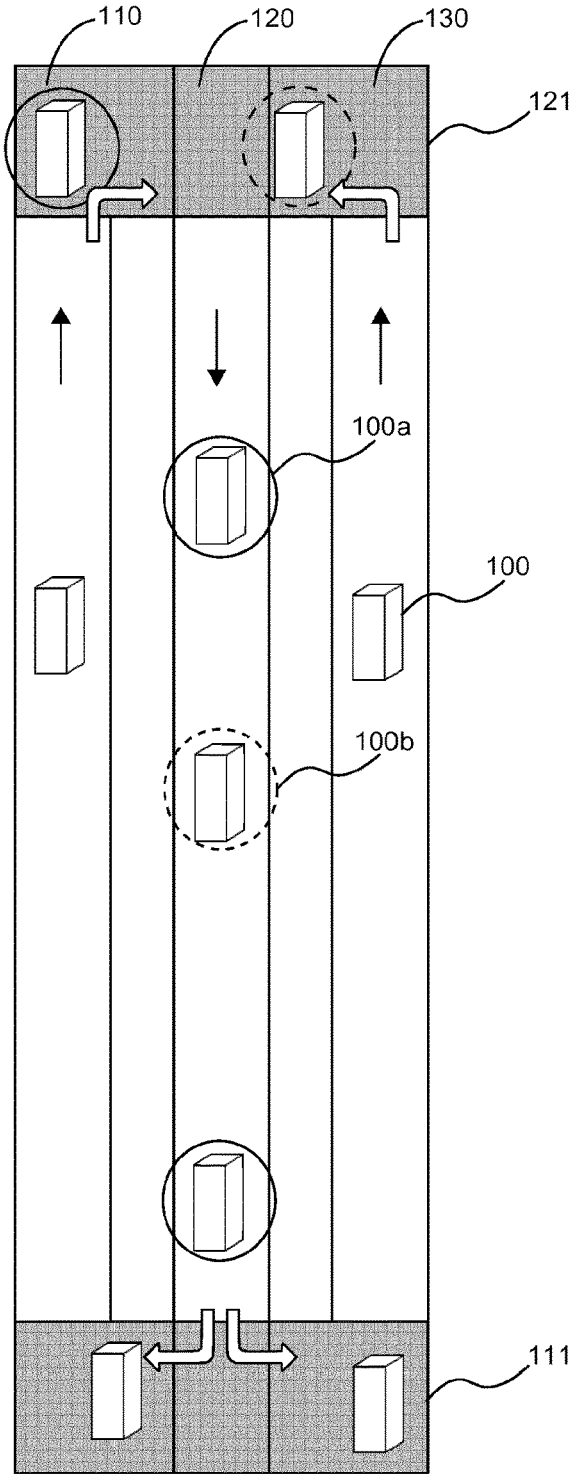
FIG. 2 shows a schematic view of a preferred embodiment of an elevator system according to the invention for illustrating a further preferred embodiment of the method according to the invention.
Figure 3:
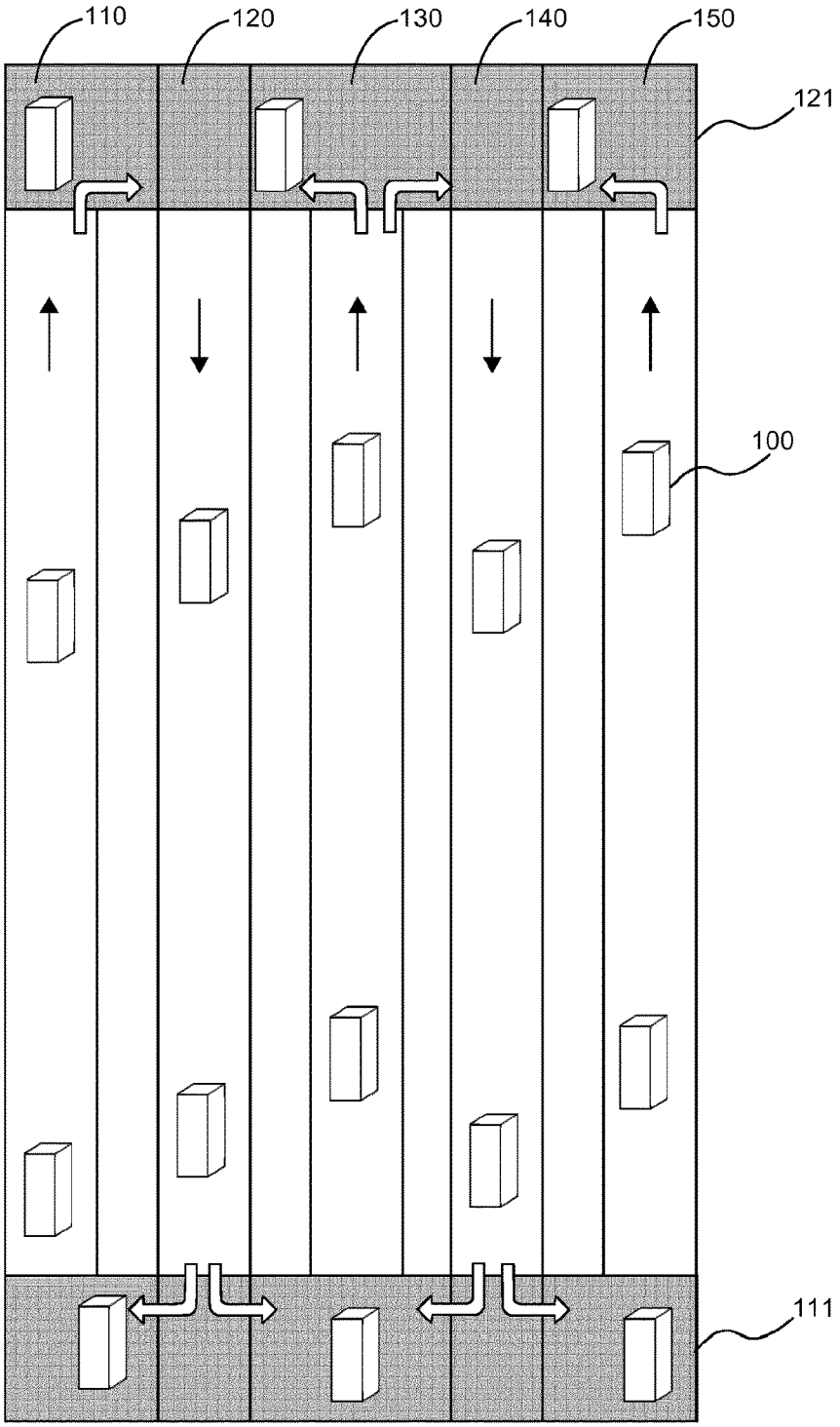
FIG. 3 shows a further schematic view of a preferred embodiment of an elevator system according to the invention for illustrating a further preferred embodiment of the method according to the invention.

With reference to FIGS. 2 and 3, further preferred embodiments of the method according to the invention for operating an elevator system will now be illustrated. FIGS. 2 and 3, which will be described below in a partially comprehensive manner, illustrate a number of cars, wherein the cars are each identified with 100. The elevator systems, which, in turn, are identified with 10, are also embodied here as shaft-changing multi-car systems.

In the embodiment of FIG. 2, a total of 11 cars 100 for three elevator shafts 110, 120, 130 are provided. According to the embodiment of FIG. 3, a total of 15 cars 100 are provided for a total of five elevator shafts 110, 120, 130, 140, 150. The assignment of respective travel directions UP or DOWN, respectively, can be seen by means of corresponding arrows.

Curved arrows furthermore symbolize that the individual cars can be moved between the individual elevator shafts by means of changing mechanisms.

FIG. 2 illustrates an operating state according to the first operating state (state A) of FIG. 1. The main travel direction is thus the upwards direction here.

It is thus to be assumed in this operating state that a majority of the passengers enters the building, in which the elevator system is provided, on a lower floor 111, and wants to be transported to one of the floors between this floor 111 and a top floor 121. The floors located in-between are not illustrated in detail in FIG. 2 as well as in FIG. 3. It is to be assumed in this situation that only very few passengers want to be transported from an upper to a lower floor. In this situation, the travel direction UP is thus the main travel direction of the elevator system.

It is to thus typically be assumed that an average travel time of a car 100 in an elevator shaft 110 or 130 from the lowermost floor 111 to the top floor 121, where the cars are horizontally moved into the elevator shaft 120 by means of a changing mechanism, is significantly longer than the duration of a downwards ride from the top floor 121 to the lowermost floor 111.

The transportation capacity of the elevator system as a whole can thus be increased in that a portion of the cars 100, which move in downwards direction in the elevator shaft 120, is not available for passenger traffic. In particular, the elevator controller 160 can assign information YES or NO to every car 100, which is located in the elevator shaft 120, wherein the assignment of this information determines, whether the respective car is available for the passenger traffic or for calls, respectively, in a travel direction DOWN. As a whole, it can thus be ensured that the average cycle time, thus the time between two consecutive cars at a location, for example, a main stop, is reduced, so that the time for an up and down movement of a car can be reduced as a whole. The efficiency or transportation capacity, respectively, of the system as a whole is thus increased.

It is important to note that such an assignment of information YES or NO is also possible for cars, which are located in the shafts 110 or 130, respectively. Under normal operating conditions, however, it is to be assumed that such an assignment for the illustrated operating state only makes sense for cars in the elevator shaft 120.

To further illustrate this, it will be assumed that cars identified with 100*a* and surrounded by a solid circle in FIG. 2 is available to the public, thus have an assignment YES. A car 100*b*, which is bordered by a dashed circle, is not available for this, the state NO is thus assigned to this car.

It is possible, for example, to assign corresponding YES or NO information, respectively, to every second car, every third car, or to n of m cars (with $n<m$) in any manner. The control system can make this decision by means of different information, for example learning system, sensors, isolating devices, etc.

A corresponding handling is possible according to the embodiment of FIG. 3, wherein, as mentioned, five elevator shafts 110-150 are provided here. It can be seen that the main travel direction is the upwards direction here, to which three elevator shafts 110, 130, 150 are assigned. As described, YES or NO information, respectively, can also be assigned here in particular to the cars, which move in downwards direction through the elevator shafts 120, 140 in an advantageous manner.

It is important to point out that the illustrated elevator systems are able to compensate the malfunction of one or a plurality of elevator shafts in a particularly efficient manner, and to switch over between different operating states, which are caused by a malfunction of an elevator shaft.

The method according to the invention can be used in a particularly advantageous manner in connection with so-called shuttle elevators. Such shuttle elevators serve to transport passengers across a plurality of floors without stopover. Typical shuttle elevators run between a ground floor and a connecting floor in a higher area of a high-rise building. If the main traffic direction in the morning, for example, is the upwards direction, it can be ensued according to the invention that cars moving in downwards movement can be made available for the shuttle operation in upwards direction again in a highly effective manner.

The invention claimed is:

1. A method for operating an elevator system, which is embodied as shaft-changing multi-car system, in the case of which a number of cars is assigned to at least three elevator shafts, wherein the cars can be moved in upwards direction and downwards direction inside the individual elevator shafts, as well as between the individual elevator shafts, comprising the following steps:

a) in a first operating state, assigning a travel direction UP or DOWN to each individual one of the elevator shafts such that all cars, which are located in a respective elevator shaft, can move only in the respective assigned travel direction, b) for an elevator shaft or a partial quantity of the at least three elevator shafts, canceling the assignment of the travel direction such that all cars, which are located in this one elevator shaft or this partial quantity of the at least three elevator shafts, is or are stopped, respectively, c) reversing the assignment of the travel direction in this one shaft or this partial quantity of the at least three elevator shafts such that all cars, which are located in this one elevator shaft or the partial quantity of the at least three elevator shafts, can move only in the respective newly-assigned travel direction, d) repeating steps b) and c) for further elevator shafts, until a desired number of elevator shafts or all elevator shafts have an assignment of a travel direction UP or DOWN, which is opposite to the assignment during the first operating state, for providing a second operating state, wherein the reversal of the travel directions assigned to the individual elevator shafts is carried out successively, in order to get from the first operating state to the second operating state.

2. The method as claimed in claim 1, wherein the assignment of all further elevator shafts is maintained during the steps b) and c).

3. The method as claimed in claim 2 wherein during the first operating state, a travel direction UP is assigned to a plurality of elevator shafts and a travel direction DOWN is assigned to a minimum number of elevator shafts, and, in the second operating state, a travel direction DOWN is assigned to a plurality of elevator shafts and a travel direction UP is assigned to a minimum number of elevator shafts or vice versa.

4. The method as claimed in claim 3 wherein a movement of cars between the elevator shafts is carried out in at least one of an upper and a lower area of the respective elevator shafts.

5. The method of claim 1 wherein for operating an elevator system comprising at least one group of three elevator shafts, wherein, in the first operating state, an exclusive travel direction UP is assigned to two shafts in each of the at least one group, and a travel direction DOWN is assigned to one elevator shaft, and, in the second operating state, an exclusive travel direction DOWN is assigned to two elevator shafts, and an exclusive travel direction UP is assigned to one elevator shaft.

6. The method of claim 1, wherein the information YES or NO is assigned to each car such that, in the event the information YES is assigned to a car, this car is available to transport passengers, and that, in the event that NO is assigned to a car, this car is not available to transport passengers.

7. The method of claim 6, wherein in the event that NO is assigned to a car, this car can be moved in upwards direction or downward direction, respectively, according to a travel direction, which is assigned to a respective elevator shaft, in which the car is located, but is not available for picking up passengers.

8. The method of claim 3, wherein the state NO can only be assigned to a car, if it is located in an elevator shaft, which belongs to a current minimum number of the elevator shafts.

9. The method as claimed in claim 8 wherein at least one of a switchover from a first to a second operating state and an assignment of information YES or NO to a car is carried out as a function of at least one captured piece of information.

10. An elevator system, which is embodied as shaft-changing multi-car system, in the case of which a number of cars is assigned to at least three elevator shafts, wherein the cars can be moved in upwards direction and downwards direction inside the individual elevator shafts, as well as between the individual elevator shafts, comprising:

a) means for assigning a travel direction UP or DOWN to each of the individual elevator shafts such that all cars, which are located in a respective elevator shaft, are moved only in upwards direction or downwards direction, respectively, b) means for canceling the assignment of the travel direction for an elevator shaft or a partial quantity of the at least three elevator shafts such that all cars, which are located in this one elevator shaft or this partial quantity of the at least three elevator shafts, is stopped, c) means for reversing the assignment of the travel direction in this one shaft or this partial quantity of the at least three elevator shafts such that all cars, which are located in this one elevator shaft or the partial quantity of the at least three elevator shafts, are moved only in one travel direction, which is opposite to the travel direction thereof in the first operating state, d) means for repeating the steps b) and c) for further elevator shafts, until a desired number of elevator shafts or all elevator shafts have an assignment of a travel direction UP or DOWN, which is opposite to the original assignment according to feature a).

* * * * *